United States Patent [19]

Watson et al.

[11] 4,163,650

[45] Aug. 7, 1979

[54] PORTABLE ELECTRONIC PRECIPITATOR

[75] Inventors: Clifford A. Watson; David W. Bonham, both of Garland, Tex.

[73] Assignee: Tepco, Incorporated, Garland, Tex.

[21] Appl. No.: 927,541

[22] Filed: Jul. 24, 1978

[51] Int. Cl.[2] ..... B03C 3/01

[52] U.S. Cl. ..... 55/126; 15/339; 15/352; 15/415 R; 55/138; 55/319; 55/356; 55/467; 55/428; 55/139; 98/115 R

[58] Field of Search ..... 55/124–126, 55/128, 129, 138, 139, 319,356, 467, 428, 470–473; 98/115 R; 15/339, 415 R, 347, 352

[56] References Cited

U.S. PATENT DOCUMENTS

| | | | |
|---|---|---|---|
| 2,115,482 | 4/1938 | Crewe | 55/467 |
| 2,347,334 | 4/1944 | Schmieg | 98/115 R |
| 3,719,030 | 3/1973 | Blankemeyer et al. | 55/356 |
| 3,740,926 | 6/1973 | Duval | 55/126 |
| 4,129,426 | 12/1978 | Furasen | 55/473 |

*Primary Examiner*—Bernard Nozick

*Attorney, Agent, or Firm*—Hubbard, Thurman, Turner, Tucker & Glaser

[57] ABSTRACT

A portable electronic precipitator includes a two-stage type electrostatic percipitator mechanism mounted in a portable cabinet such as a wheel-mounted cabinet. The two stage type electrostatic percipitator is mounted in a vertical position with the inlet for the precipitator, containing the ionizer unit at the lower end of the precipitator with the collecting cell being mounted above the ionizer unit. A suitable fan is contained within the cabinet to pull air through the ionizer unit and then through the collector cell. The electrostatic precipitator mechanism is mounted above a particle fallout chamber. A freestanding arm, which is moveable in any desired direction is also mounted on the cabinet with a flexible hose surrounding and supported by the adjustable freestanding arm. The flexible hose completely surrounds the freestanding arm structure whereby no external support for the hose is required, thereby allowing the apparatus to be used in confined spaces with the hose protecting the freestanding arm structure.

10 Claims, 7 Drawing Figures

PORTABLE ELECTRONIC PRECIPITATOR

BACKGROUND OF THE INVENTION

This invention relates to portable electronic precipitators for removing airborne particulate materials from air or some other gaseous material. In another aspect, this invention relates to a portable electronic precipitator which is mounted on a movable cabinet means and having an adjustably supported flexible hose means for collecting contaminated air or other gaseous material from a concentrated source.

Electronic precipitators, such as two-stage electrostatic precipitators, have been widely used for removing suspended particulate materials from air and other gaseous streams. Such precipitators have been effectively utilized to remove airborne particulate materials, including solids and liquids such as smoke, oil mist, metal particles, dust particles, and the like, from air and inhabited structures.

There have been suggestions of "portable" electronic precipitators for removing undesired particles from air. However, most such "portable" precipitator mechanisms usually involve the installation of the precipitator in a semi-permanent fashion and structures such as by attaching the precipitator to a wall-mount bracket and the like. It is apparent that there is a need for some type of truly portable precipitator for removing particulate materials from air and the like. For example, in many industrial processes, there are certain operations that will intermittently discharge large amounts of harmful or undesirable particulate materials into the air. It would be extremely uneconomical to install electronic precipitators instructures and in locations where they are only intermittently used. For example, processes such as welding, grinding, and the like may take place at many different locations and at different times in a structure. It would be highly desirable to have some type of an electronic precipitator that could be moved from one location to the other to collect airborne particles, such as smoke, dust, metallic particles, oil mist, acid mist, and the like. This is especially true in view of the current trends in occupational safety and health requirements wherein great sums of money are being spent to improve the safety and environment considerations of industrial facilities. In fact, there are now many governmental regulations that require the elimination of discharge of dust, metal particles, acid mists, oil mists, and the like into the atmosphere from industrial operations. Additionally, there are very stringent limitations on the amounts of such airborne particles that can be present in one area where workers may come into contact with such airborne contaminants. As a result, elaborate filters, duct means and the like have been devised to remove particulate materials from the air or to redirect them away from areas where the workers would come in contact with them. Such elaborate filters, duct means, and blowers are highly expensive to install and to operate. With this in mind, it, of course, would be highly desirable to have some type of portable electronic precipitator apparatus that could be easily moved from one location to another to capture particulate materials from air and other gaseous mediums in a safe and effective way. It would be especially desirable to have some type of apparatus that could capture and remove particulate materials from a small and concentrated area, such as in the area of a welding operation, a spray paint operation, a grinding operation, or other type of industrial operation which produces particulate materials, suspended in a gaseous medium such as air.

SUMMARY OF THE INVENTION

Accordingly, it is an object of this invention to provide a portable electronic precipitator. It is another object of this invention to provide a portable electronic precipitator that can be utilized to collect particulate materials from a small and concentrated area and remove such particles from a gaseous medium such as air. It is still a further object of this invention to provide a new and improved portable electronic precipitator having an adjustable and supported hose or conduit means for collecting particulate materials from a small and concentrated area.

Other aspects, objects, and advantages of this invention will be apparent to those skilled in the art from the following disclosure and appended claims.

In the instant invention, a portable electronic precipitator includes a suitable cabinet means which can be readily moved from one location to another. The cabinet means includes and contains an electronic precipitator mechanism such as a two-stage type electrostatic precipitator having an ionizer unit and a collector cell. The two-stage type electrostatic precipitator is normally vertically mounted whereby the ionizer unit is mounted below the collector cell with the path of air or other gaseous medium passing generally upwardly through the ionizer unit and thereafter into the collector cell. The cabinet further includes a freestanding and supported hose or conduit means that can be adjustably positioned to gather air or other gaseous medium containing particulate material from a particular locality by positioning the free end of the hose or conduit in the locality of the gas borne particulate material. The other end of the hose or conduit passes into the cabinet means in a downward fashion and into a particle fallout chamber wherein the heavier particulate materials are allowed to settle out by means of gravity and fall into a suitable collector tray due to the decreased velocity of air or gas containing the particulate material. The air or gas from the particle fallout chamber then passes upwardly through the two-stage type electrostatic precipitator. Suitable means for pulling the air or vapor containing the suspended particulate materials into the hose or conduit and then directing such air or vapor through the precipitator mechanism, such as a fan, blower or the like, are also included in the cabinet. The entire cabinet assembly is mounted on some easily moveable base, such as skid-mount base or a base with suitable wheels or rollers whereby it can be easily moved from one location to another. The hose or conduit means is supported by a freestanding arm mechanism which is affixed to the cabinet structure in such a fashion as to allow the freestanding arm to be adjustably positioned to any desired position. The hose or conduit means is slipped over the free-standing arm mechanism whereby the freestanding arm structure supports the hose or conduit means from the inside of such flexible hose or conduit. Suitable joints are included in the freestanding arm means to allow it to be freely moved upwardly and downwardly to position the free end of the hose or conduit at any desired height and at any desired distance away from the cabinet. A swivel mount of the lower end of the freestanding arm mechanism to the cabinet structure allows the positioning of the hose or conduit to any desired horizontal plane.

DESCRIPTION OF THE PREFERRED EMBODIMENTS

Figure 1:
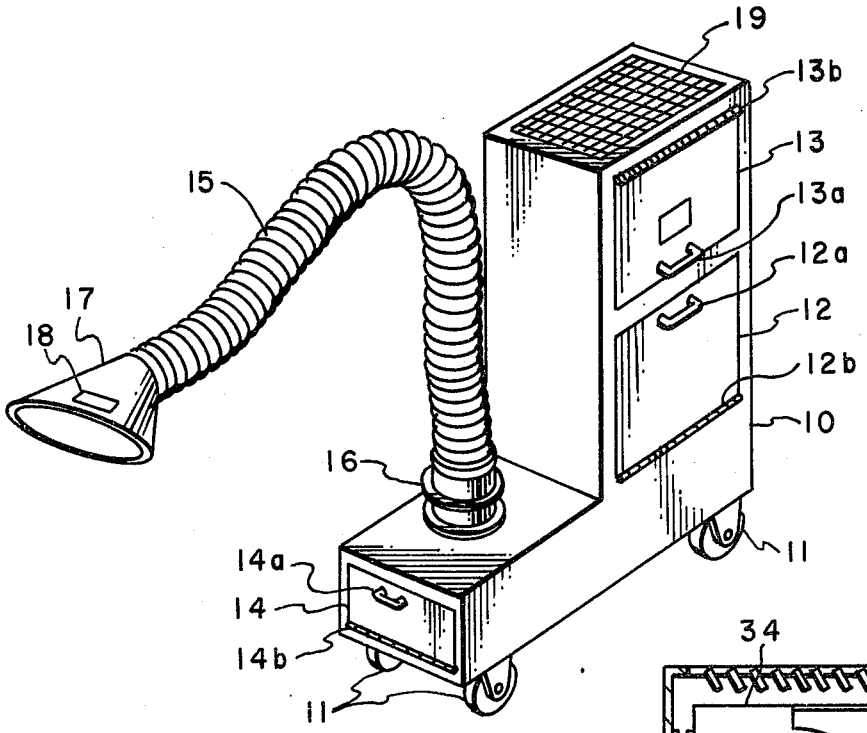
FIG. 1 is a perspective view of the apparatus of this invention.

The instant invention can best be described by referring to the drawings. In FIG. 1, a perspective view is presented of an apparatus in accordance with the instant invention. The apparatus includes cabinet mean 10 for containing and mounting the various components therein. In the illustrated embodiment, cabinet means 10 is a sheet metal type construction cabinet with suitable internal supports, such as angle iron supports to give the cabinet the desired rigidity and support. As shown, cabinet means 10 is mounted on rollers 11 to allow the entire structure to be readily moved from one location to another. In one side panel of cabinet means 10, precipitator access door 12 is positioned to allow ready access to the precipitator ionizer unit and collector cell, as will be more fully described hereinafter. Precipitator access door 12 is hinged about hinge **12*b* and includes door latch 12*a* to allow the door to be locked in a closed positioned, as illustrated. Cabinet means 10 includes floor and power supply access door 13 which is hingedly mounted to the cabinet by means of hinge 13*b* and is locked in place by latch 13*a*. This door allows ready access to to blower unit and the power supply unit, as will be discussed hereinafter. It will be noted that the precipitator unit as well as the power supply and blower units are mounted in the upper portions of the cabinet means. The lower portion of cabinet means 10 is a large open enclosed space having side walls, end walls, and bottom and top walls. This lower portion of the cabinet means serves as a particle fallout chamber whereby large particles of particulate material that are drawn into the cabinet means tend to settle out by the action of gravity on such particles and fall into a particle tray, as will be hereinafter described. To allow access to the particle tray, for cleaning and the like, particle tray door 14 is positioned in the end wall of the lower portion of the cabinet. Particle tray door 14 is hingedly affixed to cabinet 10 by means of hinge 14*b* and is locked in a closed position by means of latch 14*a***.

Flexible hose means 15 is affixed to cabinet 10 by means of hose swivel base 16 as will be described hereinafter, hose swivel base 16 is attached to the lower portion of cabinet means 10 such that an aperture cut into the upper surfaces of the cabinet means allows for open communication between the lower end of flexible hose 15 and the particle fallout chamber with the flexible hose being allowed to swivel about the mount to thereby allow the hose to be twisted into any desired position. The upper free end of flexible hose 15 is affixed to nozzle means 17 which can be positioned adjacent a concentrated source of airborne particulate material to allow such airborne particulate material to be sucked into the end of the nozzle, downwardly through flexible hose 15 and into the particle fallout chamber in the closed lower portion of cabinet means 10. Nozzle means 17 can be of any desired configuration. However, nozzle means 17 will normally be a somewhat conical-shaped nozzle that can be readily affixed or attached to the open upper end of flexible hose 15. In one preferred embodiment of this invention, a suitable viewing window 18 can be installed in the walls of nozzle means 17, whereby the nozzle can be positioned directly over the workpiece that will be generating the airborne particulate material, such as over a grinder, a welding operation and the like. This allows the nozzle to collect essentially all of the airborne particulate material generated by the industrial operation while allowing the worker to observe the operation being carried out through the viewing window. In the case of a welding operation, viewing window 18 may be a dark, smoked glass that can serve as a suitable light screen thereby allowing the user of the instant apparatus to carry out a welding operation without the necessity of a bulky and uncomfortable welding mask.

The topmost portion of cabinet means 10 can include a suitable grid screen or louvred structure 19 to allow clean air to be passed outwardly from the inside of the cabinet after it has passed through the precipitator mechanism to remove essentially all of the particulate materials. As more clearly illustrated in FIG. 2, cabinet means 10 includes a lower closed portion 20 which serves as the particle fallout chamber. Particle fallout chamber 20 is enclosed by top and bottom walls, the end walls and the side walls of the lower portion of cabinet 10 so as to form a large closed area. When high-velocity air, containing particulate material is drawn into particle fallout chamber 20, through flexible hose 15, the velocity of the air is substantially decreased in the chamber, and larger particles of the particulate material tend to fall out and are trapped in particle tray 21, which is a large tray that covers a significant portion of the floor of fallout chamber 20. As the amount of particles in particle tray 21 increases the tray can be removed for easy cleaning and dumping of the particles of particle tray access door 14, which is shown partially open in FIG. 2. Under normal operating conditions, particle tray door 14 would be closed to thereby form an essentially air-tight fallout chamber 20 with the exception of the aperture in communication with flexible hose 15 and the opening passing upwardly into the electrostatic precipitator mechanism, which will be hereinafter described.

The two-stage type electrostatic precipitator used in the instant invention is mounted in a vertical orientation within the upper portion of cabinet means 10. The inlet for lower end of the electrostatic precipitator is in open communication with a portion of fallout chamber 20. If desired, a mechanical air filter 40 is removably mounted between the particle fallout chamber and the ionizer unit. If desired, mechanical air filter 40 may be any suitable mechanical filter, such as a glass wool-type filter or a metal shavings-type filter to trap larger sized solid particles or materials before they entire the upper portion of the cabinet.

The necessary motive force for moving air through nozzle means 17 and flexible hose 15 downwardly into particle fallout chamber 20 and then upwardly through the electrostatic precipitator and finally out through grid 19 is supplied by blower unit 30. Blower unit 30 can be any conventional type of blower or fan apparatus such as a squirrel cage fan blade mechanism 31 which is powered by a suitable electric motor 32 which is coupled to the squirrel cage rotor by means of pulley belt 33. Motor 32 is mounted on plate **32*a* which has one end pivotally pinned to the housing of fan 31 and the other end which is supported by adjusting screw 32*b* for adjusting the tension of pulley belt 33. The outlet for the blower exhausts outwardly through grid 19** to discharge cleaned air back into the atmosphere.

In the illustrated embodiment, the precipitator mechanism is a two-stage type of electrostatic precipitator and includes an ionizer unit 42 and a collecting cell unit 44 located downstream of the ionizer unit. Each of the ionizer unit and collector cell extend across the entire width of the interior of cabinet 10 and each is removably mounted within the cabinet by means of slideways formed by channels 46 which are secured to the side walls of cabinet 10 and which run horizontally along such side walls. By means of opening precipitator access door 12, both the ionizer unit and collecting cell units can be removed from cabinet 10 for easy cleaning and servicing. Collecting cell unit 44 is provided with handle 48 to facilitate its removal from the cabinet.

The ionizer unit 40 includes a four-sided frame-like metal chassis 50 having a horizontally spaced series of horizontal metal plates or fins (not shown) which extend from the front panel end 51 to the rear panel end (not visible) of the chassis 50. Located intermediate these horizontal fins are vertically extending ionizer wires (not visible) which are strung between the ends of inwardly extending metal fingers 52 which form parts of and extend toward the left from a pair of side-located horizontally running channel members 53 (the rearward one of which is hidden by the forward one). The channel members 53 are spaced from the chassis 50 by means of electrical insulators 54. The application of a relatively high positive voltage to the ionizer wires causes a corona discharge between such wires and the grounded fins, the latter being grounded by way of the ionizer chassis 50 and the cabinet 10. The gaseous ionization thus produced by such corona discharge serves to charge the suspended airborne particles as they move through the ionizer unit 40.

Figure 2:
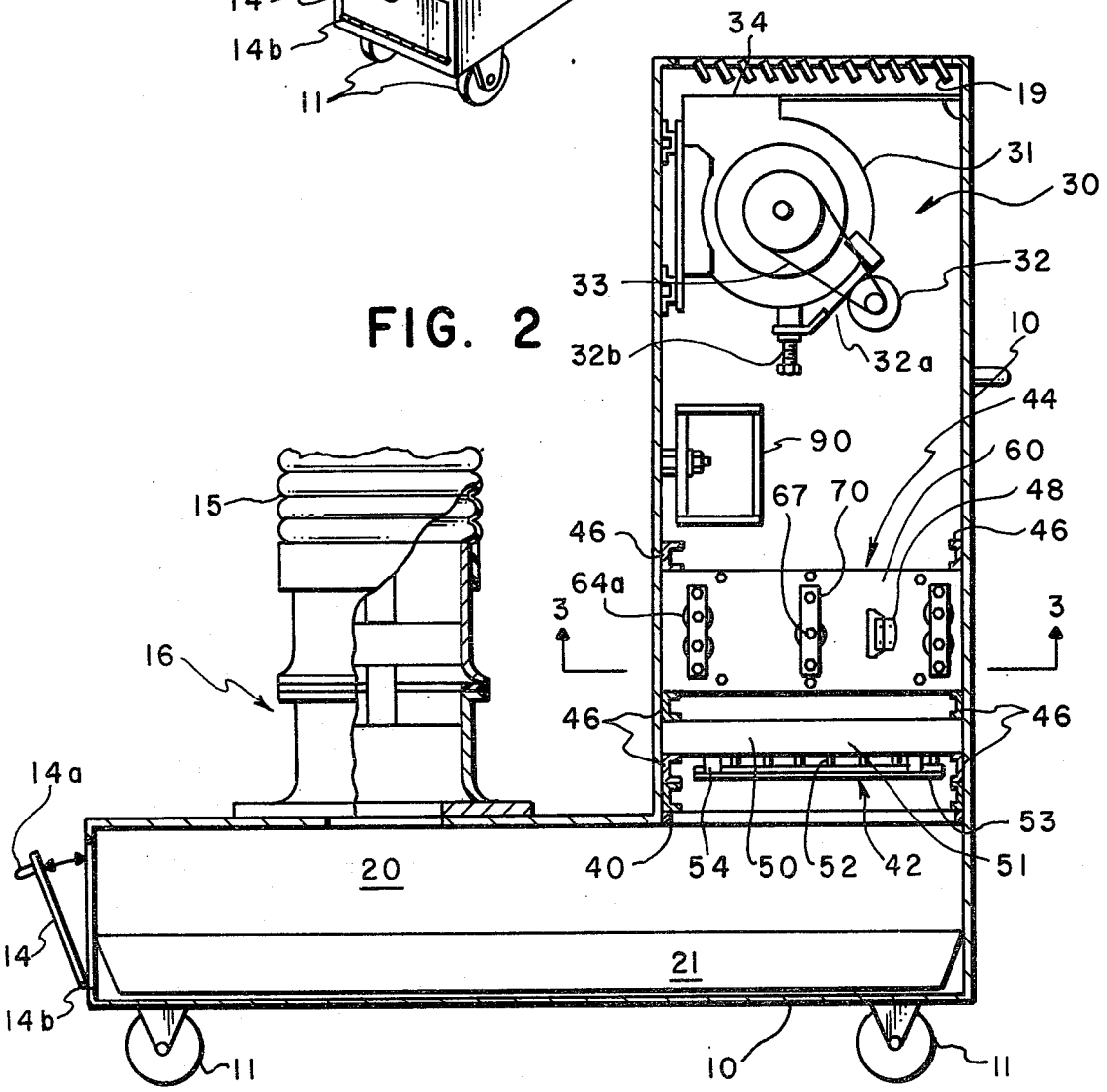
FIG. 2 is a side view of the apparatus shown in FIG. 1 with the side panels removed to show the location of the various internal components of the apparatus and with a portion of the flexible hose or conduit means being removed to show the swivel base structure of the freestanding arm means.
Figure 3:
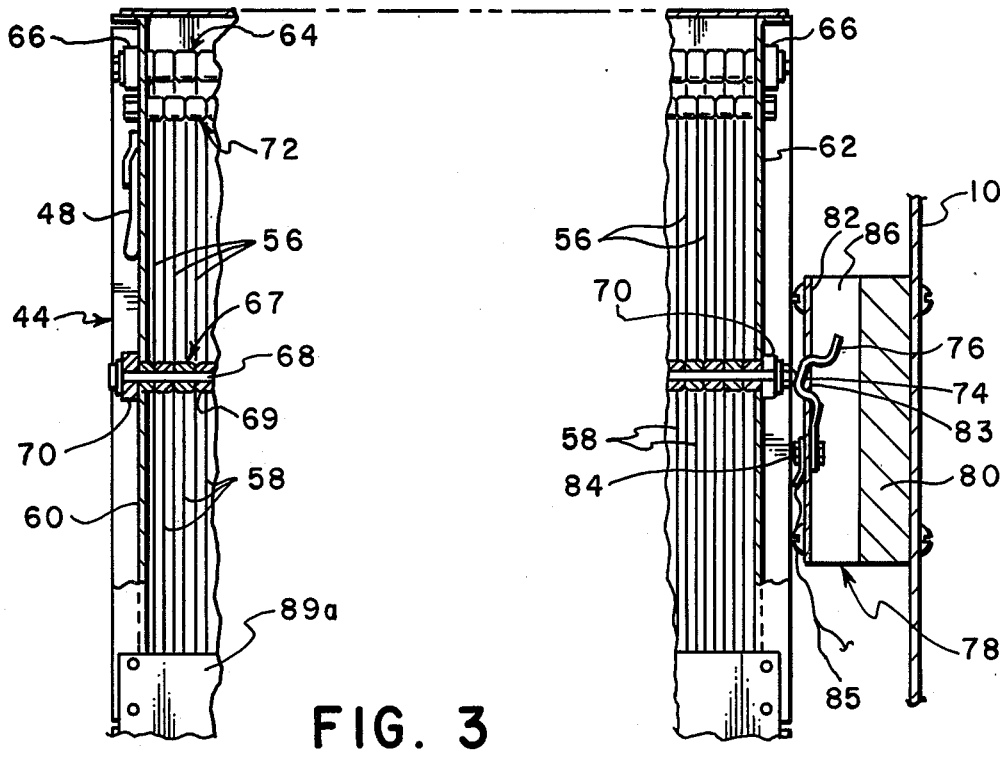
FIG. 3 is a bottom view taken along section line 3—3 of FIG. 2 and showing further details of the collecting cell.

FIG. 3 is a cross-sectional view taken along line 3—3 of FIG. 2 and shows in greater detail the construction of the collecting cell unit 44. Such collecting cell unit 44 includes a group of spaced electrically conductive elements located in the air flow path for removing from the air the airborne particles charged by the ionizer unit 40. As seen in FIG. 3, these electrically conductive elements comprise two interleaved sets of spaced parallel plates, the plates in the first set being designated by reference numeral 56 and the plates in the second set being designated by reference numeral 58. Plates 56 will be referred to as the positive plates, while plates 58 will be referred to as the negative plates. When in place in cabinet 10, the positive plates 56 are connected to a source of high positive voltage, while the negative plates 58 are grounded to the cabinet. In FIG. 3, the plates 56 and 58 are being viewed in an edgewise manner, such plates being supported between and extending parallel to a pair of end plates 60 and 62, the former of which is seen in elevation in FIG. 2. Thus, the collecting cell plates 56 and 58 have their larger surfaces disposed in line with the direction of air flow.

The positive plates 56 are supported near their four corners by four spacer assemblies 64 which pass through end plate holes **64*a* (FIG. 2) and are bolted to insulator blocks 66 which are, in turn, bolted to the end plates 60 and 62. A further positive plate spacer assembly 67 extends through the middle of the collecting cell plates. As seen in FIG. 3, such center spacer assembly 67 comprises an elongated metal bolt or shaft 68 having a series of metal spacer rings 69 mounted thereon. Shaft 68 passes through small, tight-fitting holes in the positive plates 56. Spacer rings 69 clamp the plates 56 in position and maintain the desired spacing therebetween. Such rings 69 pass through holes in the negative plates 58 and end plates 60 and 62 of larger diameter than the rings 69 such that there is no electrical contact therebetween. The ends of spacer shaft 68 are bolted to insulator blocks 70 which are, in turn, bolted to the end plates 60 and 62. The construction is such that all of the positive plates 56 are in electrical contact with the center shaft 68 and the plates 56 and shaft 68 are electrically insulated from both the negative plates 58 and the end plates 60 and 62**.

Negative plates 58 are supported in a somewhat similar manner by means of spacer assemblies 72 located near the four corners thereof. The metal center shafts of these spacer assemblies 72 are bolted directly to the end plates 60 and 62 for purposes of grounding the negative plates 58 to the cabinet 10. The negative plates 58 are somewhat longer in the direction of air flow than positive plates 56 so that spacer assemblies 72 may be located clear of the positive plates 56.

Electrical contact is made with the positive plates 56 by means of a nut 74 on the rearward end of the center spacer shaft 68. When the collecting cell unit 44 is in place in the cabinet 10, this nut 74 engages a contact spring 76 in a contact assembly 78 mounted on the inner wall of the side panel of the cabinet 10. Contact assembly 78 includes an insulator block 80 which is bolted to the side panel and a support plate 82 which is bolted to the front side of the insulator 80. Contact spring 76 is a strip of resilient metal material bent to provide a forwardly extending hump portion which extends through an opening 83 in the support plate 82. The lower end of contact spring 76 is secured to the plate 82 by screws 84. The lugged end of an insulated conductor wire 85 is looped over and makes contact with one of the screws 84. Conductor wire 85 runs to an electrical power supply unit to be considered hereinafter. A vertical slot or channel 86 is cut into the insulator block 80 for accommodating the contact spring 76.

Figure 4:
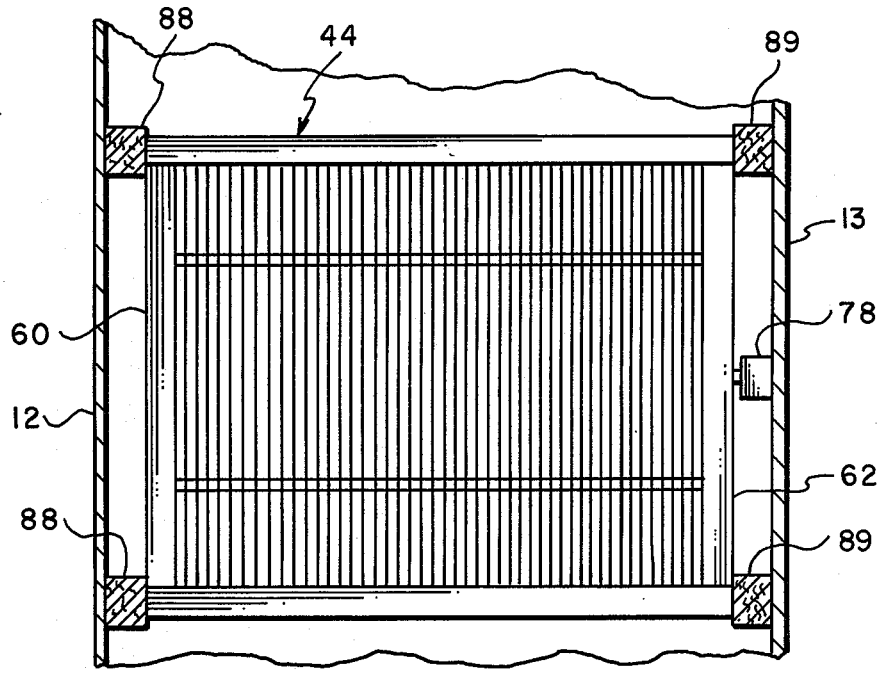
FIG. 4 is a side elevational view of the collecting cell used in the apparatus of this invention.

FIG. 4 shows a side view of the collecting cell unit 44. A pair of horizontally extending resilient sealing strips 88 are secured to the inside of door 12 for engaging end plate 60 of collecting cell unit 44, while a second pair of horizontally-extending resilient sealing strips 89 are secured to the inside of the side panel of the cabinet for engaging the other end plate 62 of unit 44. These strips 88 and 89 may be made of felt or other suitable material and serve to prevent air flow on the exterior sides of the end plates 60 and 62. Side baffle plate 89a prevents air flow past the collecting cell unit 44 in regions beside the effective areas of collecting plates 56 and 58. Thus, undesired blow-by is prevented and the efficiency of the precipitator unit is increased.

Figure 5:
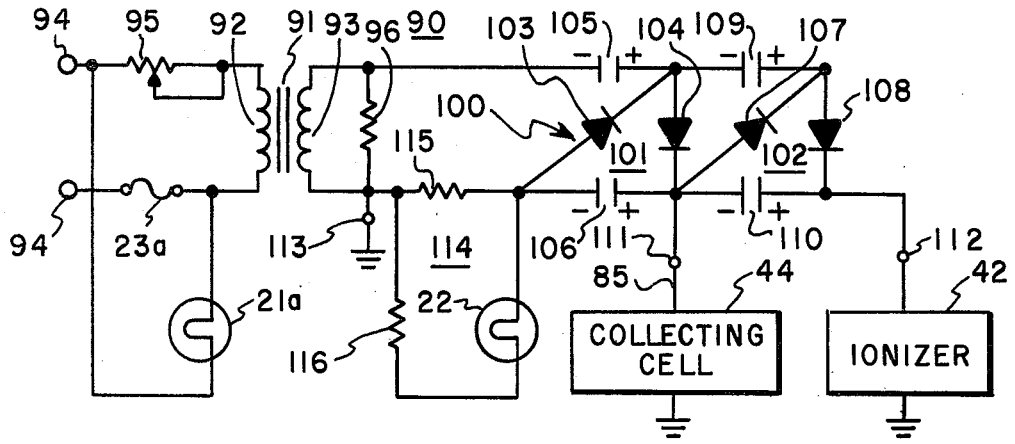
FIG. 5 is an electrical circuit diagram of one embodiment of a power supply unit that can be utilized in the illustrated portable electronic precipitator.

Referring to FIG. 5 there is shown the circuit diagram for a power supply unit 90 carried within the cabinet 10 for producing the desired electrical potential differences between the conductive elements in the ionizer unit 42 and the collecting cell unit 44. Physically, the power supply unit 90 is secured to the side panel of cabinet 10 at the location indicated in FIG. 2. As seen in FIG. 5, the power supply unit 90 includes a voltage step-up transformer 91 having a primary winding 92 and a secondary winding 93. Primary winding 92 is coupled to a pair of terminals 94 which are adapted to be connected to a source of alternating-current power such as, for example, an alternating-current power line. A rheostat 95 is connected between one of the terminals 94 and one end of the primary winding 92. A fuse 23a (located in fuse holder 23) is connected between the other terminal 94 and one end of the primary winding 92. A red-colored indicator lamp 21a is connected in parallel with the rheostat 95 and a secondary winding 92 for indicating that the high-voltage power supply unit 90 is being energized.

Connected to the secondary winding 93 of the step-up transformer 91 is a rectifier circuit 100 of the voltage quadrupler type. A bleeder resistor 96 is also connected across secondary winding 93 to stabilize the loading on transformer 91 and thus the voltage across secondary 93. Quadrupler circuit 100 includes a first voltage doubler 101 connected in cascade with a second voltage doubler 102. Voltage doubler 101 includes a pair of semiconductor diodes 103 and 104 and a pair of capacitors 105 and 106. The second voltage doubler 102 includes a pair of semiconductor diodes 107 and 108 and a pair of capacitors 109 and 110. High-voltage output terminals for the quadrupler circuit 100 are indicated at 111 and 112. A common ground return terminal is indicated at 113, such terminal 113 being grounded to the cabinet 10.

The operation of the quadrupler circuit 100, which is well known in the electrical arts, is such that there is produced between the first high-voltage output terminal 111 and the ground terminal 113 a direct-current voltage difference of approximately (slightly less than) twice the peak value of one-half cycle of the alternating-current voltage appearing across the secondary winding 93 of the step-up transformer 91. There is produced between the second high-voltage output terminal 112 and the ground terminal 113 a direct-current voltage difference equal to (slightly less than) twice the voltage difference between the first high-voltage terminal 111 and the ground terminal 113. The voltages at terminals 111 and 112 are of positive polarity. In the present embodiment, the turns ratio of the step-up transformer 91 is constructed so that, with an input voltage of 90 volts at terminals 94, the magnitude of the positive direct-current voltage apearing at the first high-voltage terminal is approximately 4.4 kilovolts, while the magnitude of the positive direct-current voltage appearing at the second high-voltage terminal 112 is approximately 8.4 kilovolts, both being measured with respect to the ground terminal 113.

As indicated in FIG. 5, the first or lower-value high-voltage terminal 111 is connected to the positive plates 56 in the collecting cell 44 by way of the conductor wire 85 and the contact assembly 78 previously considered. The second or higher-value high-voltage output terminal 112, on the other hand, is connected to the ionizing wires in the ionizer unit 42. An important feature of this FIG. 6 power supply embodiment is that the circuit is constructed so that the ionizer 42 cannot operate unless the collecting cell unit 44 is also operating. This results from the fact that units 42 and 44 are connected directly to the voltage doublers 101 and 102 and from the further fact that the second doubler 102 cannot function unless the first doubler 101 is operating. This interlock feature prevents the undesired escape of ionized particles into the room in the event the collecting cell unit 44 should become inoperative.

Connected in circuit with the power supply means represented by step-up transformer 91 and rectifier circuit 100 is indicator means 114 for providing an alarm signal when the electrically conductive plates 56 and 58 in the collecting cell unit 44 become too dirty. This indicator means includes a current-sensing element represented by a current-sensing resistor 115 connected in series with the transformer secondary winding 93 and the rectifier circuit 100 for sensing the leakage current passing between the collecting cell plates 56 and 58. The indicator means further includes an amber-colored indicator lamp 22 and a current-limiting resistor 116 connected in series across the current-sensing resistor 115. When the leakage current flowing between the positive and negative collecting plates 56 and 58 indicates that the build up of the particle film on such plates has reached the critical level, the voltage drop across the current-sensing resistor 115 reaches a value sufficient to cause a lighting of the indicator lamp 22. This provides a visual alarm signal which indicates that the collecting cell plates 56 and 58 have become too dirty.

The collecting cell unit 44 is constructed so that the spacing between neighboring ones of the positive and negative collecting cell plates 56 and 58 is not more than 0.205 inches. The high-voltage power supply unit 90 is constructed so that the voltage difference or potential difference between negative and positive plates 56 and 58 is less than 5,000 volts. This collecting cell spacing and collecting cell potential difference are significantly less than those used in conventional precipitator apparatus. It has been found, however, that such reduced spacing and voltage parameters provide an improved air cleaning action while, at the same time, decreasing the amount of ozone produced. The desired spacing factor between neighboring collector cell plates is obtained by the proper choice of lateral dimensions for the various spacer rings used on the spacer assemblies 64, 67 and 72. The desired potential difference value is obtained primarily by proper proportioning of the turn ratio in the step-up transformer 91. Rheostat 95 enables some adjustment of the high-voltage output values but is included primarily for purposes of compensating for differences in alternating-current power line voltages at different places of use.

In the illustrated embodiment of this invention, an important feature is the freestanding and supported hose for conduit assembly. The improved assembly includes a freestanding and adjustable arm mechanism which is affixed to the upper surfaces of the lower portion of cabinet 10. By utilizing the freestanding arm mechanism of this invention, it is possible to adjust the hose assembly to allow the nozzle means to be directed to any desired location, within the physical length of the hose assembly. The hose assembly is supported from the inside of the hose whereby there is no awkward and cumbersome support structure on the outside of the hose. Therefore, the hose is actually slipped over the outside of the freestanding and adjustable arm assembly. The freestanding and adjustable arm assembly is made from components such as lightweight by strong tubular materials whereby it is not unduly heavy, thereby causing undesired torque on the cabinets and adjusting joints. Additionally, the size of the freestanding arm means should be relatively small so such structure will not unduly obstruct the air passages within the large diameter flexible hose.

Figure 6:
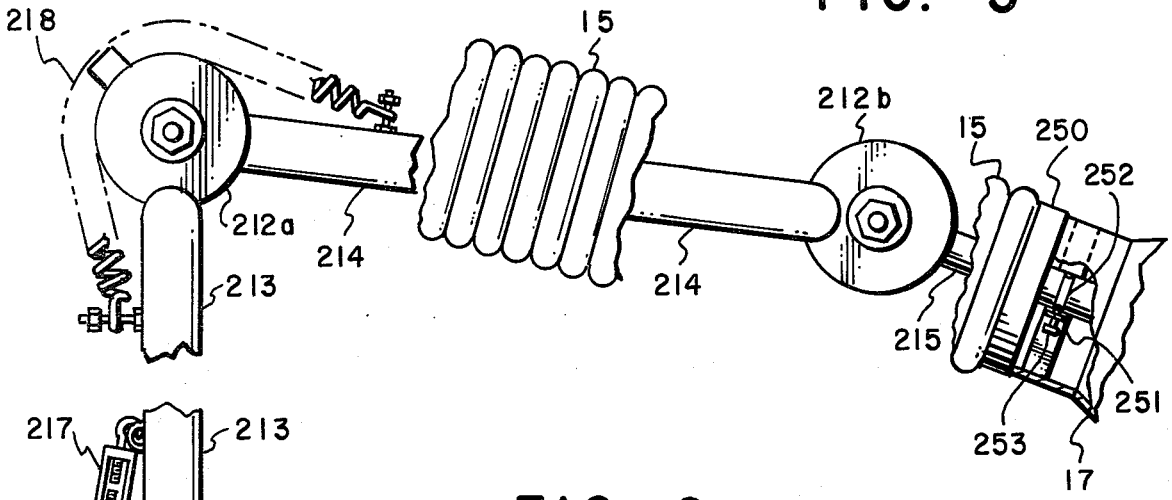
FIG. 6 is a side-elevational view of the freestanding arm means of the instant invention, with portions of the apparatus being removed to illustrate the construction of the arm means.
Figure 6:
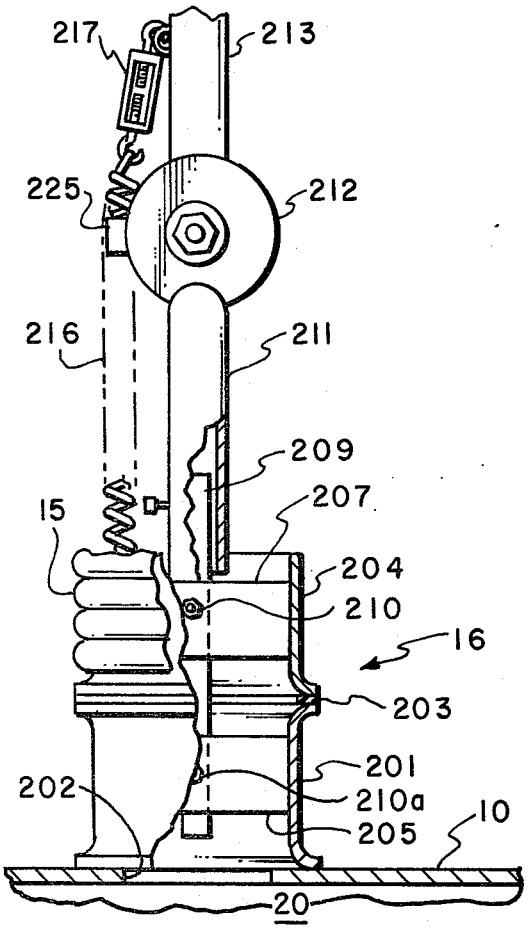
Figure 7:
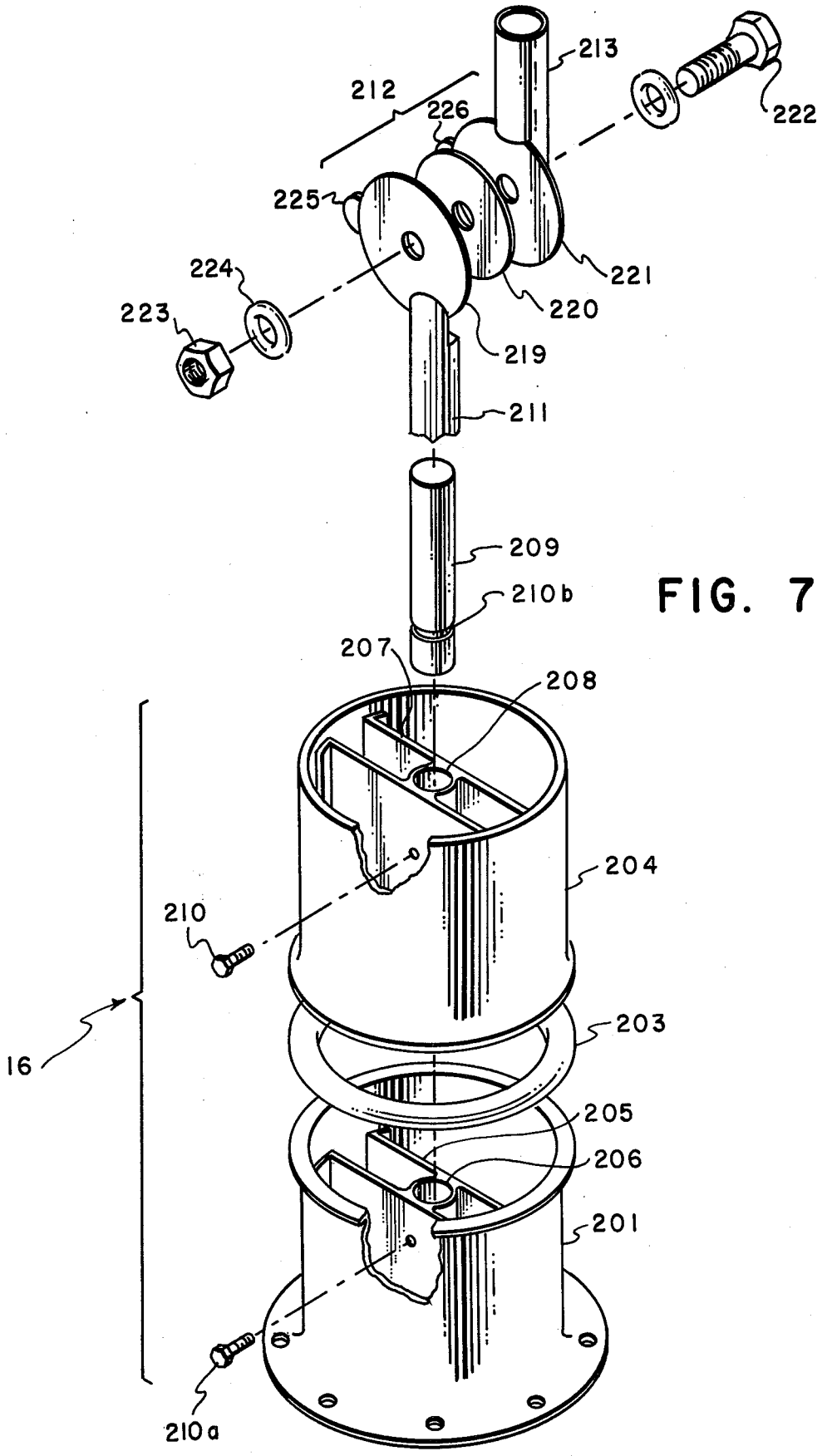
FIG. 7 is an exploded view of the swivel base of the freestanding arm means and one of the friction joints of the free-standing arm means utilized to support and position the flexible conduit or hose used in the instant invention.

As illustrated in FIG. 6, a cutaway view of a portion of the freestanding arm assembly is sized to fit within the interior of flexible hose 15. For purposes of illustration, most of hose 15 has been removed to show the details of hose swivel base 16 and the other components of the adjustable freestanding arm mechanism. By examining FIG. 6, it will be noted that swivel base 16 is made up of lower ring 201 which is affixed to the upper surfaces of the lower portion of cabinet means 10 by any suitable means, such as by bolting it in place. Bolt holes in the lower flanged portion of lower ring 201 are shown in FIG. 7. Aperture 202 is cut in the surfaces of cabinet 10 whereby lower ring 201 is in open communication with particle fallout chamber 20. Bearing means 203 is positioned along the flanged surfaces of the upper portion of lower ring 201 to allow the free rotation of upper ring 204 to allow the hose mechanism to be swivelled about swivel base 16. As more clearly illustrated in FIG. 7, which is an exploded view of a portion of swivel base 16, it will be noted that lower ring 201 has an upper flanged surface with bearing means 203 resting along the upper flanged surface. Upper ring 204 has a lower flanged surface that rests along the top portion of bearing means 203. Bearing means 203 can be any suitable bearing means, such as an asbestor pad, a lubricated rubber pad, and the like, to allow the free rotation of upper ring 204 across the surfaces of the bearing means as the hose assembly is swivelled about the assembly. Bearing means 203 allows easy rotation of the upper ring 204 while maintaining a substantially air tight seal between the upper and lower rings. Within the interior of lower ring 201, lower bridge 205 is rigidly affixed to the interior walls of the lower ring. The function of lower bridge 205 is to provide bore 206 for the insertion of a portion of the upper arm assembly, as will be described hereinafter. Likewise, upper bridge 207 is rigidly affixed to the interior walls of upper ring 204 to support upper bore 208 which is sized to receive a portion of the freestanding arm assembly. In the assembly of swivel base 16, upper and lower bores 208 and 206 are brought into alignment and elongated rod 209 is passed downwardly through bores 208 and 206. Elongated rod 209 is preferably a circular rod that is sized to allow it to freely rotate within bores 206 and 208. If desired, elongated rod 209 can be held in place in upper ring assembly 204 by means of set screw 210 which is screwed into a suitable aperture which is drilled through the walls of upper bridge 207 and into 208. By tightening set screw 210, elongated rod 209 can be held firmly in place within bore 208 to prevent its free rotation. Therefore, in a torque exerted on upper ring 204 will cause upper ring 204 and downwardly extending elongated rod 209 to rotate about the surfaces of bearing means 203 with the lower portion of elongated rod 209 rotating freely within bore 206. The lower end of elongated rod 209 can have annular groove **210*b* cut around its periphery whereby set screw 210*a* can be screwed into a suitable aperture which is drilled through the walls of lower bridge 205. The end of set screw 210*b* will not normally be tightened to an extent where it frictionally engages the lower portion of annular groove 210*b* but will allow elongated rod 209 to rotate within bore 206 while preventing elongated rod 209 from being pulled upwardly and out of bore 206. Thus set screw 210*a* and annular groove 210*b* allow free rotation of the free standing arm assembly without the arm assembly being lifted off base swivel assembly 16 without first loosening set screw 210*b*. Tubular member 211 is slipped over the upper end of elongated rod 209 and extends upwardly to support the remainder of the freestanding arm assembly. Tubular member 211 can be any desired length and extends upwardly to adjustable joint 212 which will be described in more detail later. The function of adjustable joint 212 is to allow the remaining portion of the freestanding arm assembly to be adjusted to position the flexible hose in a desired configuration. A second tubular member 213 is affixed to adjustable joint 212 and extends upwardly to a second adjustable joint 212*a*. A third tubular member 214 is also affixed to adjustable joint 212*a* and extends to the third adjustable joint 212*b*. Nozzle means 17 is operably connected to third adjustable joint 212*b* by means of tubular member 215**.

Nozzle means 17 can be held in place by means of bridge means 251, which is similar to bridge means 205 and 207 of lower ring 201 and upper ring 204, with tubular member 215 extending into a bore within bridge means 251. Set screw 253 can be screwed into an aperture in the wall of bridge means 251 to allow set screw 253 to engage annular groove 252 around the periphery of tubular member 215. With this arrangement, nozzle means 17 can be rotated around the axis of tubular member 215 without the danger of nozzle 17 being pulled off the end of tubular member 215. Such an adjustable arrangement allows the inlet of nozzle 17 to be aimed in any suitable direction from the axis of tubular member 215.

It will be appreciated that the lengths of various tubular members 211, 213, 214, and 215 are suitable lengths to allow flexible hose 15 to be slipped over the entire freestanding arm assembly and allow the lower end of hose 15 to be sealedly affixed to lower ring 204 with the upper end of the hose to be sealedly affixed to nozzle 17. It has been found desirable to use a pleated-type hose such as a reinforced rubber pleated hose in the instant assembly. The hose or flexible duct assembly is thus completely supported by the freestanding and adjustable arm assembly which is positioned inside the flexible hose. By twisting the various adjustable joints, the nozzle of the hose assembly can be adjusted to any horizontal plane, within the limits of the length of the hose and the freestanding arm assembly components. Also, by twisting the various adjustable joints, the hose nozzle 17 can also be adjusted to have it extend outwardly away from cabinet means 10. By means of the swivel base assembly, the entire freestanding arm assembly with its supported hose and nozzle can be rotated about the axis of lower ring 201 by virtue of elongated rod 9 rotating within lower bore 206.

It will be appreciated that the components utilized for constructing the freestanding arm assembly should be relatively lightweight yet rigid. Even by using lightweight components and by using relatively lightweight hose material, there will still be a considerable amount of torque exerted on the adjustable joints 212, 212*a*, and 212*b*, especially when the hose assembly is extended outwardly from the cabinet in a near horizontal direction. To overcome some of the torque that will be exerted on such adjustable joints, counterbalance springs can be affixed to portions of the freestanding arm assembly to help support the weight of the apparatus. For example, lower counterbalance spring 216 can be affixed to lower ring 204, as illustrated in FIG. 6 with the spring assembly extending up over a portion of adjustable joint 212 and thereafter attaching to tubular member 213. By proper adjustment of the tension of lower counterbalance spring 216, a considerable amount of torque can be relieved from the surfaces of adjustable joint 216, when tubular member 213 is adjusted outwardly away from a vertical position. The tension of lower counterbalance spring 216 can be adjusted by turnbuckle 217 if desired. Likewise, upper counterbalance spring 218 can be adjusted to relieve some of the undesired torque on adjustable joint 212*a* by affixing one end of upper counterbalance spring 218 to tubular member 213, with the other end of upper counterbalance spring 218 being affixed to a portion of tubular member 214. If desired, a third counterbalance spring can be utilized with adjustable joint 212*b*. It can be easily installed around joint 212*b* by affixing the ends thereof to tubular members 214 and 215 by means of suitable screws, eye bolts and the like.

Adjustable joints 212, 212*a*, and 212*b* can all be constructed in basically the same fashion. As illustrated in FIG. 7, an exploded view of adjustable joint 212 shows tubular member 211 rigidly affixed to first friction plate 219. First friction plate 219 is preferably a flat plate that has relatively large surface area for bearing against friction disc 220. Friction disc 220 can be any suitable disc such as an asbestos disc, a lubricated rubber disc, a copper alloy disc, and the like which will exert frictional force on first friction plate 219, as the joint is assembled. Tubular member 213 is affixed to second friction disc 221 and bears against the other face of friction disc 220 as the joint is assembled. The joint is assembled by forming aligned apertures through first and second friction plates 219 and 221 and friction disc 220. Joint bolt 222 is passed through the aligned apertures and joint adjusting nut 223 is threadingly engaged about the threads of joint bolt 222. By tightening joint adjusting nut 223, it will be appreciated that any desired amount of frictional force can be exerted by first and second friction plates 219 and 221 on the surfaces of friction disc 220. By proper adjustment of such frictional force exerted on the friction disc, the freestanding and adjustable arm assembly can be utilized to move the various elongated tubular members into any desired configuration to thereby position the flexible hose as desired. In one preferred embodiment of the invention, Bellville washer 224 can be placed between first friction disc 219 and joint adjusting nut 223 to allow the proper frictional forces to be exerted on the joint.

If desired, retainer brackets 225 and 226 can be placed on first and second friction plates 219 and 221 to hold counterbalance spring 216 in place.

Flexible hose or duct 15 should be of sufficient length to slip over the entire length of the freestanding arm assembly whereby one end of the hose or duct can be attached to upper ring 204 to form a substantially airtight seal with the other end being attached to the base of nozzle means 17 to form a substantially airtight seal. A suitable slip joint will normally be incorporated in the base of nozzle 17 to allow the open enlarged end of the nozzle to be rotated about the axis of tubular member 215 as described above. Suitable "hose clamps" and the like can be utilized for affixing the ends of the hose in place.

Required power for operating the apparatus of this invention can be supplied by suitable electrical outlet cords which have not been illustrated.

It will be appreciated that the foregoing description of the apparatus of this invention can be modified in many different ways to still gain the benefits of our invention. For example, any known type of electronic-type precipitator can be utilized in the apparatus. Additionally, it may be desired to have the electronic precipitator equipped with such components as mechanical shakers for cleaning the collector cell, additional filters, additional duct means for directing the exhaust air away from the cabinet, and the like. It will also be appreciated that the portable apparatus can be mounted on motorized vehicles, moveable pallets and the like. While the apparatus has been described as having the electronic precipitator mounted in a vertical configuration, it will also be appreciated that the precipitator can be mounted horizontally with the ionizer unit in the collector chamber position side by side. It will further be appreciated that the precipitator may be mounted beside or to the end of particle fallout chamber 20 if desired even though it is usually desired to mount the precipitator above the particle fallout chamber as illustrated.

Various other changes and modifications can be made in the apparatus of this invention without departing from the scope of our invention.

We claim:

1. A portable electronic precipitator apparatus which comprises:

a. a portable cabinet structure;

b. An enlarged particle fallout chamber formed by the lower portion of said cabinet structure;

c. a two-stage type electrostatic precipitator contained within said cabinet structure with the inlet of said electrostatic precipitator being in open communication with said particle fallout chamber and with the outlet of said electrostatic precipitator being oriented to direct a gas stream out of said cabinet structure;

d. an adjustable freestanding arm assembly affixed to and supported by said cabinet structure;

e. an elongated flexible duct means surrounding and supported by said adjustable arm assembly with one end of said duct means being in open communication with said particle fallout chamber; and f. means to direct a gas having particulate material suspended therein into the free end of said flexible duct means whereby said gas flows through duct means, into said particle fallout chamber, through said two-stage electrostatic precipitator for removal of at least a portion of the particulate material from said gas and then to direct the thus cleaned gas out of said cabinet structure.

2. The apparatus of claim 1 wherein said freestanding arm assembly is affixed to said cabinet assembly by means of a swivel base assembly whereby said arm assembly and the flexible duct means surrounding said arm assembly are adapted to swivel in any desired direction with respect to said cabinet structure.

3. The apparatus of claim 2 wherein said freestanding arm assembly includes a plurality of elongated tubular members operably connected to said swivel base assembly with at least one adjustable joint means connecting said elongated tubular members to allow the free end of said flexible duct means to be adjustably positioned at any desired vertical or horizontal distance from said cabinet structure.

4. The apparatus of claim 3 wherein said adjustable joint means are friction joints formed by friction plates rigidly affixed to the adjacent terminal ends of said elongated tubular members with said friction plates being oppositely opposed and with means to bring said friction plates into frictional engagement.

5. The apparatus of claim 4 wherein said friction joints further include means to adjust the frictional engagement between said oppositely opposed friction plates.

6. The apparatus of claim 5 wherein said freestanding arm assembly further includes at least one counterbalance spring having its opposite ends affixed to the intermediate portions of adjacent elongated tubular members, said counterbalance being affixed to said elongated tubular members whereby the tension thereof relieves a portion of the torque on said adjustable joint means as the free end of said duct means is positioned away from said cabinet structure.

7. The apparatus of claim 6 wherein said free end of said duct means comprises a nozzle means for collecting a gas stream containing suspended particulate material therein.

8. The apparatus of claim 3 wherein said electrostatic precipitator is positioned above said particle fallout chamber.

9. The apparatus of claim 8 wherein said electrostatic precipitator is positioned with the collector ce-1 being above the ionizer unit thereof.

10. The apparatus of claim 9 wherein a removable particle fallout tray is positioned in the lower portion of said particle fallout chamber.

* * * * *